United States Patent [19]

McNeil

[11] Patent Number: 4,630,405

[45] Date of Patent: Dec. 23, 1986

[54] FINISHING CHAMBER AND FINISHING MACHINE COMPRISING THE SAME

[75] Inventor: Gary L. McNeil, Allegan, Mich.

[73] Assignee: Roto-Finish Company, Inc., Kalamazoo, Mich.

[21] Appl. No.: 809,575

[22] Filed: Dec. 16, 1985

Related U.S. Application Data

[62] Division of Ser. No. 706,143, Feb. 27, 1985.

[51] Int. Cl.[4] ..... B24B 31/00

[52] U.S. Cl. ..... 51/163.2

[58] Field of Search ..... 51/163.2, 163.1, 164.1, 51/313; 228/182; 29/455 R, 458, 460

[56] References Cited

U.S. PATENT DOCUMENTS

| | | | |
|---|---|---|---|
| 2,938,233 | 2/1976 | Cannon | 29/455 R X |
| 3,100,088 | 8/1963 | Podmore et al. | 51/163.2 |
| 3,246,394 | 4/1966 | Meyer | 29/455 R X |
| 3,546,821 | 12/1970 | Strom | 51/163.2 |
| 3,553,900 | 1/1971 | McKibben | 51/163.2 |
| 3,882,643 | 5/1975 | Knartzer | 51/163.2 |
| 4,235,363 | 11/1980 | Liller | 29/455 R X |
| 4,307,544 | 12/1981 | Balz | 51/163.2 |
| 4,329,817 | 5/1982 | Balz | 51/163.2 |

*Primary Examiner*—Harold D. Whitehead
*Attorney, Agent, or Firm*—Gordon W. Hueschen

[57] ABSTRACT

A novel method of forming a finishing chamber by inserting a cylindrical tube into a corresponding opening in the bottom of a dished tank head having a bottom and an upwardly-extending outer wall, inserting a cone-shaped gusset or collar having an outwardly and downwardly-extending skirt and an opening in the top thereof, corresponding to the circumference of the cylindrical tube, over the tube and with its outer circumference in contact with the tank head, and welding the tube to the tank head and to the gusset and the gusset to the bottom of the tank head, thereby simply to provide the essentials of a finishing chamber, is disclosed. The outer wall of the finishing chamber may be extended by welding a sheetform annular ring to the top of the outer wall of the tank head, and the chamber may be lined with elastomer and fitted with a screen deck. The chamber itself and finishing machines embodying the same are also disclosed, and are characterized by simplicity of fabrication and structural stability of the chamber, and numerous advantages in operation which follow therefrom.

5 Claims, 5 Drawing Figures

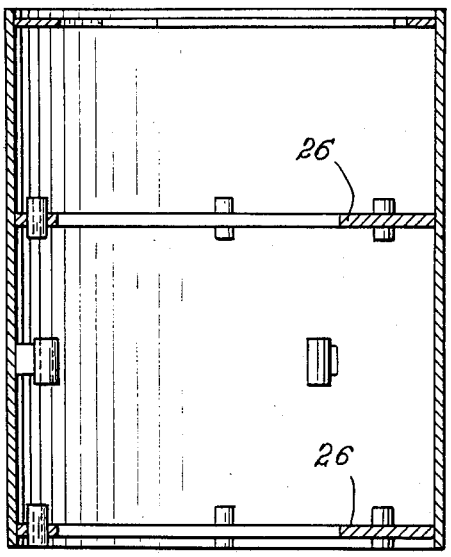
Fig. 1.
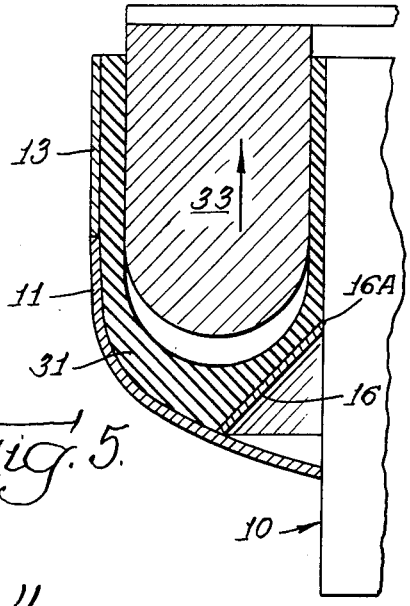
Fig. 5.
Fig. 4.
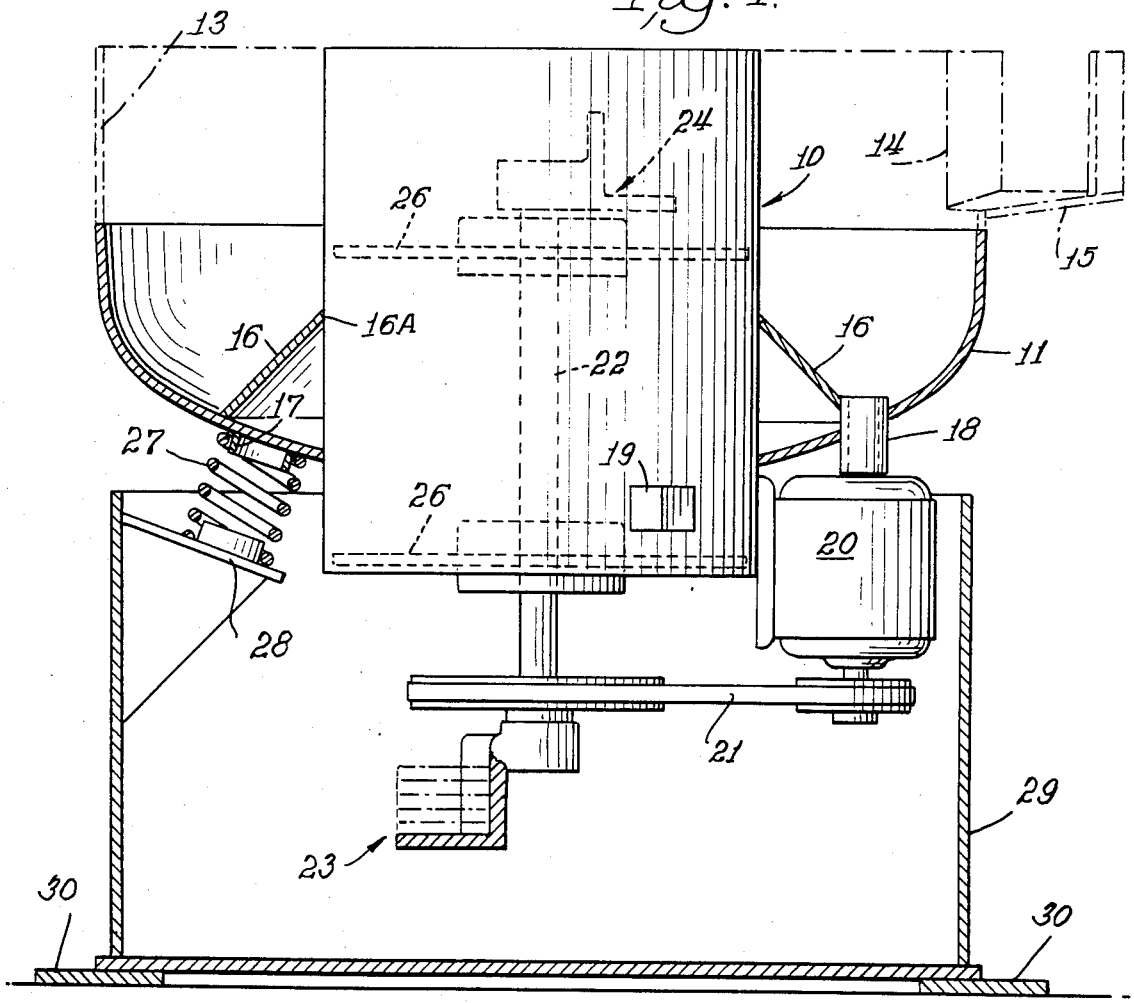

FINISHING CHAMBER AND FINISHING MACHINE COMPRISING THE SAME

This is a division of application Ser. No. 706,143, filed Feb. 27, 1985.

BACKGROUND OF THE INVENTION

1. Field of the Invention

The field of the present invention is chambers, especially finishing machine chambers, chambers adapted for employment as the finishing chamber of a finishing machine, especially a vibratory or vibrogyratory finishing machine, finishing machines comprising the same, and a method of production of the same.

2. Prior Art

In the past, chambers adapted for employment as the finishing chamber of a vibratory finishing machine or the like have been individually "spun" or stamped to specific dimensions for the particular use thereof as the chamber of a finishing machine or the like, each one being individually constructed according to its own particular intended use and according to a specific order including all intended specifications, dimensions, and characteristics. Otherwise, such chambers have been provided by welding one half of a cylindrical tube to the vertical walls of a central tube or column and imparting rigidity to the open channel thus provided by the employment of external supporting gussets, usually between four and twenty in number, depending upon the size, length, and other dimensions of the chamber involved. Such chambers have suffered fron numerous disadvantages due to the method of fabrication and the inherent design weaknesses and shortcomings of the structures which thus evolved.

It would be highly desirable to be able to provide such chambers particularly adapted to comprise the finishing chamber of a vibratory or vibrogyratory finishing machine or the like which are not individually created according to their specific end use and according to a specific order; but which rather employ readily-available materials and technology, although established in other fields, for their production, and which moreover avoid some of the shortcomings inherent in prior art chambers due to their method of fabrication and resulting structure. Such a desirable objective has been attained according to the present invention using existing tank head materials and technology, and according to a simplified procedure which produces a quality product having numerous advantages, many of which could not have been predicted.

For example, a chamber of the present invention does not require thermal stress relief after its production since residual stresses in the product are reduced by the opportunity, due to the unique method of fabrication employed, to eliminate welding at locations which are subject to extreme stress during use or operation. Thus, the structure provided according to the present invention does not flex in actual use, so less stress is placed upon the weldments which are employed. In addition, due to these same factors, a vibratory or vibrogyratory finishing machine employing a finishing chamber according to the present invention may be operated at the same capacity but much more quietly, up to at least three decibels more quietly, than the same machine equipped with a conventional finishing chamber. Moreover, to move the same mass of finishing media and parts to be finished, a prime mover of twenty to thirty percent less horsepower may be employed, with the same efficiency, especially in the larger models, due to the fact that energy is not wasted in flexing of the structure or fabrication but is therefore available for moving of the mass of finishing media and parts to be finished. Additionally, due to elimination of flexing in the chamber structure or fabrication produced, a more efficient finishing operation can be conducted in a chamber according to the invention, since in many existing types of finishing machine chambers the inherent weaknesses and flexing actually impart a non-uniform action to the finishing media and parts being finished, as evidenced by dead spots and non-uniform rolls of the media in different areas of the finishing chamber when the finishing operation is in progress. It is apparent that such a chamber construction having the aforesaid advantages and relative simplicity of fabrication will be enthusiastically received by the industry.

OBJECTS OF THE INVENTION

It is an object of the present invention to provide an improved chamber suitable for use as the chamber of a finishing machine, especially a vibratory finishing machine or the specific embodiment of a vibratory finishing machine known as a vibrogyratory finishing machine. A further object of the invention is the provision of a finishing machine embodying such an improved chamber. An additional object of the invention is the provision of a finishing chamber and finishing machines embodying the said chamber which substantially eliminate the aforesaid disadvantages and shortcomings of prior art finishing chambers and their structure and whereby the numerous advantages set forth in the foregoing are attained. Other objects will be apparent to one skilled in the art and still other objects of the invention will become apparent hereinafter.

SUMMARY OF THE INVENTION

The invention, then, inter alia, is directed to a method of producing a chamber suitable for employment as the finishing chamber of a vibratory finishing machine or the like, comprising the steps of:

providing an essentially cylindrical tube adapted for employment as the center column of a finishing machine, providing an essentially circular tank head, having a bottom and an upwardly extending outer wall and a circumference selected so as to constitute the outer circumference of the chamber desired to be produced and adapted to constitute the bottom portion of said chamber, with an essentially circular opening in the bottom thereof having a circumference corresponding to the circumference of said cylindrical tube, providing a cone-shaped gusset with an essentially circular opening in the top thereof and a skirt outwardly and downwardly extending from said opening, said opening having a circumference corresponding to the circumference of said cylindrical tube, said gusset having an outer circumference less than the circumference of said tank head, inserting said cylindrical tube through the essentially circular opening in said tank head, inserting said cone-shaped gusset over said cylindrical tube with its outer circumference within said upwardly extending outer wall of said tank head and into contact with said tank head, and with its circular opening around said cylindrical tube, and welding said cylindrical tube to said tank head where said tube passes through the opening therein, and said cone-shaped gusset to said tube where said tube passes through the opening therein, and said cone-shaped gusset to said tank head where the outer circumference of said cone-shaped gusset contacts said tank head; such a method wherein the tank head has an arcuate bottom; such a method wherein the tank head is an elliptical-dished tank head; such a method wherein said tank head is an elliptical-dished tank head with a ratio of diameter to height of roughly two to one; such a method wherein said tank head is flanged and dished; such a method wherein said tank head is hemispherical; such a method wherein said tank head is a low carbon steel ASME Code type; such a method wherein an upper annular wall having essentially the same circumference as the upwardly-extending outer wall of said tank head is set in place thereon and welded thereto; such a method wherein said upper annular wall is in the form of a sheetform annular ring; such a method wherein a screen support frame opening is cut into an outer wall of said chamber and a screen support frame secured therein; such a method wherein a mold is inserted within the confines of the chamber thus produced and an elastomeric lining poured within said chamber around said mold and allowed to set, thereby to provide an elastomeric lining for said chamber; and such a method wherein a member of the group consisting of a spring guide, a drain, and a shipping plate is provided in or on said chamber.

Moreover, a structure suitable for use as at least a part (and perhaps all) of the finishing chamber of a vibratory finishing machine or the like, comprising an essentially cylindrical tube comprising the center column of the finishing chamber;

an essentially circular tank head, having a bottom and an upwardly extending outer wall and a circumference selected so as to constitute the outer circumference of the chamber comprising the bottom portion of said chamber, with an essentially circular opening in the bottom thereof having a circumference corresponding to the circumference of said cylindrical tube, said cylindrical tube being inserted through the essentially circular opening in said tank head and in circumferential contact therewith, said cylindrical tube and said tank head being welded to secure them to each other at said points of contact, and the method of producing the same.

Further, a chamber suitable for use as the finishing chamber of a vibratory finishing machine or the like, comprising an essentially cylindrical tube comprising the center column of the finishing chamber;

an essentially circular tank head, having a bottom and an upwardly extending outer wall and a circumference selected so as to constitute the outer circumference of the chamber comprising the bottom portion of said chamber, with an essentially circular opening in the bottom thereof having a circumference corresponding to the circumference of said cylindrical tube, a cone-shaped gusset with an essentially circular opening in the top thereof and a skirt outwardly and downwardly extending from said opening, said opening having a circumference corresponding to the circumference of said cylindrical tube, said gusset having an outer circumference less than the circumference of said tank head, said cylindrical tube being inserted through the essentially circular opening in said tank head and in circumferential contact therewith.

said cone-shaped gusset being inserted over said cylindrical tube with its outer circumference within said upwardly extending outer wall of said tank head and in circumferential contact with said tank head, and with its circular opening around said cylindrical tube and in circumferential contact therewith, said cylindrical tube, said tank head, and said gusset being welded to secure them to each other at said points of contact; such a chamber comprising an elastomeric lining on the inner surface thereof and/or which has any or all of the further characteristics enumerated in the foregoing in connection with its method of production. Additionally, a finishing machine comprising such a chamber, and especially a finishing machine comprising such a chamber which is a vibratory finishing machine and wherein said chamber is resiliently mounted.

BRIEF DESCRIPTION OF THE DRAWINGS

A more complete understanding of the invention may be had by reference to the following detailed description when taken in conjunction with the accompanying drawings, wherein:

FIG. 1 is a section of an essentially cylindrical tube adapted to be employed as the center column of a finishing chamber according to the invention.

FIG. 4 is a section of the assembled chamber taken on line 4—4 of FIG. 3, showing the chamber in place in a vibrogyratory finishing machine.

FIG. 5 is a section through the chamber after pouring of an elastomeric liner, showing the mold being removed.

DETAILED DESCRIPTION OF THE INVENTION

Figure 2:
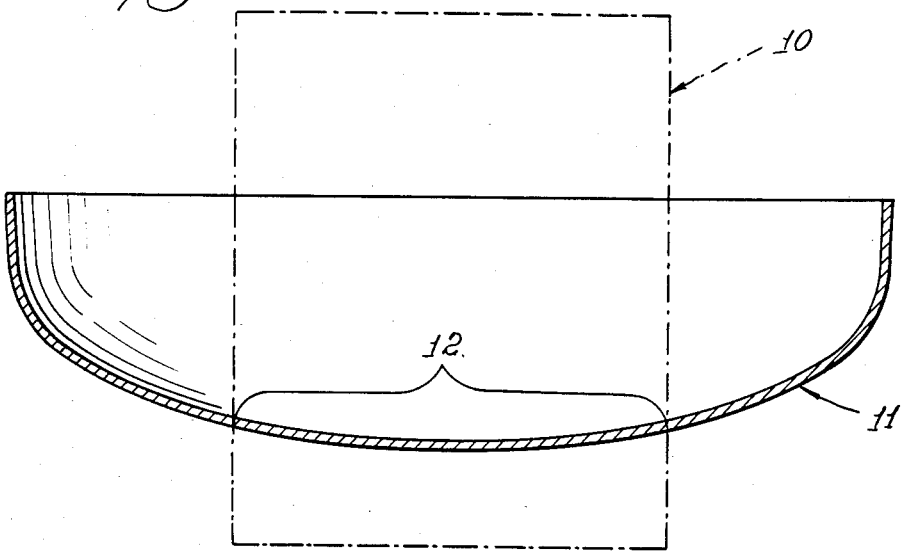
FIG. 2 is a section of a dished tank head with the cylindrical tube located in an opening therein.

Referring now to the drawings, and particularly to FIG. 1 thereof, the starting essentially cylindrical tube adapted to be employed as the center column of a finishing chamber according to the invention is shown generally in section at 10, with bearing mounting plates 26 located therein. FIG. 2 shows a section of a dished tank head, which is essentially circular, at 11. The said dished tank head has a bottom and an upwardly extending outer wall and a circumference selected so as to constitute the outer circumference of the chamber desired to be produced and is adapted to constitute at least the bottom portion of said chamber. Preferably, and as shown, the dished tank head has an arcuate bottom and an upwardly extending outer wall. At 12 is shown an essentially circular opening in the bottom of the tank head, having a circumference corresponding to the circumference of said cylindrical tube 10, which is shown in shadow lines inserted through the essentially circular opening 12 in the tank head prior to securement thereto by weldments (not shown).

Figure 3:
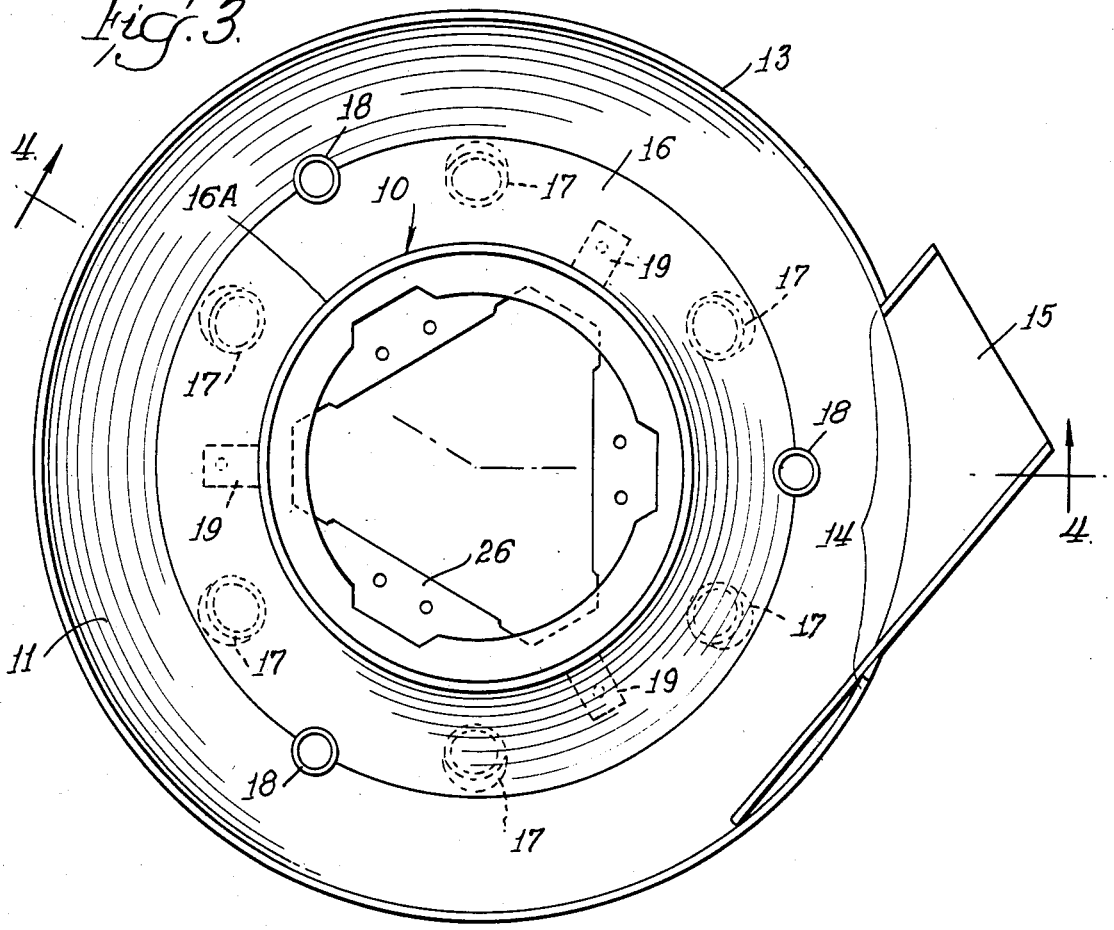
FIG. 3 is a top view of an assembled finishing chamber according to the invention.

FIGS. 3 and 4 respectively show a top view of an assembled finishing chamber according to the invention and a section of the assembled chamber taken on line 4—4 of FIG. 3, showing the chamber in place in a vibrogyratory finishing machine. From FIGS. 3 and 4, cone-shaped gusset or collar 16 is apparent, having an essentially circular opening 16A in the top thereof and a skirt outwardly and downwardly extending from said opening, the said opening 16A having a circumference corresponding to the circumference of the cylindrical tube 10, and said gusset 16 having an outer circumference less than the circumference of said tank head 11. As shown in FIGS. 3 and 4, the cone-shaped gusset 16 is inserted over cylindrical tube 10 with its outer circumference within the upwardly extending outer wall of the tank head 11 and in contact with the bottom of said tank head, and with its circular opening 16A around cylindrical tube 10. Cylindrical tube 10 is secured to tank head 11 where tube 10 passes through the opening 12 therein by weldments (not shown), cone-shaped gusset 16 is secured to cylindrical tube 10 where said tube passes through the opening 16A in gusset 16 by weldments (not shown), and said cone-shaped gusset 16 is secured to tank head 11 where the outer circumference or skirt of said cone-shaped gusset 16 contacts tank head 11 by weldments (not shown).

In FIGS. 3 and 4 other optional and preferably elements of the construction are visible, including optional but preferable and usual upper annular wall 13 having essentially the same circumference as the upwardly-extending outer wall of tank head 11, which may be set in place thereon and secured thereto by weldments (not shown). Advantageously, and as shown, this upper annular wall 13 is in the form of a sheetform annular ring. Usually, and advantageously, an opening 14 is provided in the outer wall of said chamber, preferably and usually in upper annular wall 13, to accommodate screen support frame 15, also shown in shadow lines in FIG. 4. Such screen support frame is ordinarily fitted with a suitable classification screen which, by means of a suitable ramp attached thereto which is either fixedly or moveably arranged for dipping into the mass of finishing media and parts, receives the mass for separation of finished parts from media and exit of finished parts from the finishing machine, all according to structure and practice which is well known in the art.

Referring now to FIG. 3, also shown in shadow lines are spring guides 17 for resilient mounting of the bowl in a finishing machine and shipping lugs 19, as well as drains 18 and bearing mounting plates 26.

From FIG. 4, further elements of the mounted bowl and assembled finishing machine are apparent, for example base 29, base mounting pads 30, spring guides 17, spring mounting brackets 28, and resilient mounting means for the bowl or chamber in the form of springs 27. Drive means for the vibratory finishing machine of FIG. 4 comprise universal motor 20, vertical shaft 22 mounted in bearings 25, located upon bearing mounting plates 26, and carrying lower weight 23 and upper weight 24. As shown, these weights 23 and 24 are out of phase with each other for vibrogyratory operation of the machine but, as is well known in the art, the location of the weights 23 and 24 on a vertical shaft 22 within the central column 10 may be at any desired degree out of phase with each other or even in phase with each other when vibratory as opposed to vibrogyratory effect is desired, or even a single weight may be employed if desired. Motor 20 and vertical shaft 22 are connected by pulley 21, thereby completing the drive package for the finishing machine illustrated in FIG. 4. As is conventional, those portions of the device which are located within the central tube 10 are shown in shadow lines, as are the optional but preferable upper annular wall 13 having opening 14 therein with screen support frame 15 located within said opening and secured thereto by weldments (not shown).

Either before assembling the chamber of the invention into a completed finishing machine or the like, as shown in FIGS. 3 or 4, or thereafter, the opening provided between the upwardly extending outer wall of tank head 11, optionally and preferably further extended upwardly by the provision of upper annular wall 13, usually in the form of the sheetform annular ring shown, and the cone-shaped gusset or collar 16, which opening defines the finishing chamber proper and within which finishing media and parts to be finished are ultimately to be placed, is lined with a suitable elastomeric lining 31 according to conventional practice in the art. This is conveniently accomplished by inserting a mold, preferably a unitary or one-piece mold, within the confines of the chamber defined by the upwardly extending wall of tank head 11, gusset or collar 16, the additional upwardly extending wall of the the essentially cylindrical tube 11 constituting the center column of the finishing chamber, and the optional but preferable upper annular wall 13, and pouring elastomer 31 in fluid form around the mold and allowing the same to solidify, usually with the employment of suitable release material so as to facilitate extrication of the mold from the thus-lined cavity upon completion of the lining operation. FIG. 5 shows the chamber of the invention with elastomeric lining 31 in place and with unitary mold 33 in the process of being removed from within the confines of the chamber.

The chamber thus-produced, as will be apparent to one skilled in the art, is thus readily adapted for the employment in vibratory or vibrogyratory finishing machines of all types, especially those employing as drive means a vertical shaft having one or more weights thereon and driven in any manner from a power source such as motor 20, and in the present drawings being illustrated as mounted directly upon the resiliently-mounted cylindrical tube constituting center column 10. The thus assembled and completed finishing machine, embodying the chamber of the present invention and produced according to the method of the present invention, is characterized by all of the advantages heretofore mentioned and, as seen, is uniformly and simply constructed from readily-available materials, thereby taking advantage of the technology involved in making cylindrical tubes, cone-shaped gussets or collars, and especially tank heads, and involves only a minimal welding operation, always at predetermined locations, which can be effected readily and efficiently with ready access at all contact points where welding must be effected, with resulting economies of time and integrity, stability, and security of the structure thus produced, as already mentioned.

It will be understood by one skilled in the art that the necessary weldments which are involved may take place or be programmed to take place in any order, for example, the cylindrical tube may be welded to the tank head first, and thereafter the cone-shaped gusset welded to the cylindrical tube and to the tank head, or the reverse order of weldment may be employed. Similarly, the upper annular well, if present, may be welded to the upwardly extending outer wall of the tank head first, and thereafter the screen deck opening provided therein and/or the screen deck welded or otherwise secured into said opening, or the opening may be provided and the screen deck mounted therein by weldments or the like prior to welding the upper annular wall to the upwardly extending outer wall of the tank head. Numerous other approaches to the method of fabrication will immediately be apparent to one skilled in the art, and it is only essential that the necessary elements of the assembly be provided and secured together in the manner indicated herein as by welding or its equivalent so as to provide the necessary stable securement of the various elements of the combination to each other in the assembled product.

THE TANK HEAD

The tank head employed according to the present invention may be of any standard type which has a bottom and an upstanding outer wall and which is essentially circular in nature. Preferably the tank head has an arcuate bottom. The tank head may accordingly be dished or flanged and dished, and is preferably elliptical dished. Alternatively it may be high-crown dished, hemispherical dished or the like, all of said types of dished tank heads being readily available in the art in either stainless or low carbon steel, with low carbon steel being preferred for the present application. They are representatively available from Commercial Shearing, Inc., Youngstown, Ohio, USA 44501. Preferably the tank head employed has a ratio of the major axis to the minor axis of about 2 to 1, which in general means that the ratio of the diameter to the height is approximately 2 to 1, although various other ratios are equally suitable. As already stated, although flanged and dished tank heads can be employed, as well as high crown tank heads and hemispherical tank heads, the so-called elliptical-dished tank heads, and especially those having an approximately 2 to 1 ratio of diameter to height, are preferred, as well as low carbon steel and ASME code types. The characteristics and the pedigree of such tank heads are known and readily available from the manufacturer upon request. It is therefore a simple matter, after determining the circumference or diameter of the chamber to be produced, to determine just what size and what style of tank head will be most eminently suitable for its intended use as at least the bottom portion of the chamber to be produced. These tank heads, although ordinarily employed for pressure vessels, are well suited for their intended use as the bottom portion, including the bottom and upwardly-extending outer wall or side portions, of the chamber according to the present invention. They are ordinarily produced by stamping and rolling and usually have an arcuate bottom, which may be but which is not necessarily semicylindrical, and a vertically- or upwardly-extending wall around the circumference thereof. According to the invention, and some of its embodiments, an additional upper annular wall may be secured to this upwardly-extending outer wall to provide a chamber of greater depth, but this is not necessary in all cases and especially in those cases and for those applications in which a chamber of substantial depth is not required.

THE ELASTOMERIC LINING

Any suitable and usual elastomer can be employed in producing the elastomeric chamber lining which is required according to certain embodiments of the invention and preferred for completion of the chamber. The term "elastomeric lining" as used herein is to be understood to be a lining formed of any of numerous natural or synthetic elastomers which stretch under tension, have a high tensile strength, retract rapidly, and essentially recover their original dimensions. Examples include natural rubber, homopolymers such as polychlorobutadiene, polybutadiene, polyisoprene, copolymers such as styrene-butadiene rubber, butyl rubber, nitrile rubber, ethylene-propylene copolymers, fluorine elastomers, and polyacrylates, polycondensation products such as polyurethanes, neoprene, ABS rubber, PVC rubber, silicone rubber, and polysulfide rubber, as well as chemical conversions of high polymers such as halogen-substituted rubbers. Shore A hardness between fifty (50) and (100), preferably about sixty-five (65) to ninety (90), is usually preferred. When the elastomer is of the polyurethane type, it may be prepared by the prepolymer method or by mixing the ingredients concurrently or simultaneously through several nozzles in a so-called "one-shot" application involving the instantaneous reaction of two or three components. Other details of elastomeric lining and its formation according to conventional practice of the art may be found in columns 9 and 10 of U.S. Pat. No. 4,480,411.

The elastomeric lining may advantageously be employed in a pourable form which upon setting, in the presence of a mold, results in any desired configuration of chamber lining which may be advantageous or desirable. The ADIPRENE (TM) family of urethane elastomers produced by DuPont, and CONATHANE (TM) two-component polyurethane casting systems, produced by Conap, Inc., Olean, N.Y., are particularly suitable for use in accord with the present invention. The CONATHANE TU-79 (TM) system is particularly adaptable to the production of finishing chamber linings inasmuch as it attains a Shore A hardness of 80±5 and has excellent tensile strength and compression characteristics. Moreover, upon admixture of the two parts of the two-part system, the initial mixed viscosity at 25° C. or 77° F. is only 4,000 cps, thus making it pourable into almost any configuration for the production of chamber linings according to the invention, whether in forms to be subsequently bonded to the finishing chamber wall or to a release agent on said finishing chamber wall, or whether poured directly into the finishing chamber, thereby to become self-bonding to the wall or to a thermally-activatable release agent on the interior surface thereof upon curing. With a pot-life of 35 to 40 minutes at 25° C. and the ability to cure at room or elevated temperatures, this system has been found highly satisfactory. The cure of one hour at 25° C. plus 16 hours at 80° C. is convenient and, alternatively, the applied elastomer can be cured by allowing it to stand for seven (7) days or less at 25° C. If a mold is employed, as is usually the case and which is greatly preferred in today's practice, mold releases of various types can if desired also be employed to obtain rapid, clean, and convenient release from the mold, as is now conventional in the art. The elastomeric lining is preferably bonded to the chamber wall or to a thermally-activatable release agent inside of the finishing chamber by pouring in place in fluid or semifluid condition and allowing to cure in place, with possible application of heat and use of curing agents if desired, or the lining may as previously mentioned less desirably be preformed and bonded to the interior of the finishing chamber or to a thermally-activatable release agent inside of the finishing chamber directly, with or without the application of external heat and/or further adhesive. The insertion of a unitary mold into the finishing chamber void and the pouring of the elastomer into the finishing chamber void around said mold and allowing it to cure is a preferred embodiment according to the present invention.

FINISHING MACHINES

According to the present invention, the chamber of the invention may be used in any finishing machine or the like, especially a vibratory or vibrogyratory finishing machine, such as those used for grinding, deburring, descaling, edge-breaking, polishing, bright-honing, burnishing, and any other surface finishing of parts or workpieces, which may and generally do comprise wood, metal, ceramic, glass, or the like. Such finishing chambers are generally lined with an elastomer and such elastomer usually has a Shore A Hardness of at least 50, usually 50 to 100, and preferably about 65 to about 90. Further details and characteristics of such elastomeric linings are well known in the art, and reference is made to U.S. Pat. No. 4,162,900, representatively illustrating a vibratory finishing machine embodying a finishing chamber with an elastomeric lining, and U.S. Pat. Nos. 3,161,993; 3,981,693; 3,990,188; 4,012,869; 4,022,012; 4,172,339; 4,177,608; 4,307,544; 4,329,817, and U.S. Pat. No. RE 27,084, as well as U.S. Pat. No. 4,480,411, for various other types of finishing machines which may advantageously embody a chamber of the present invention in either lined or unlined condition, as may be desired by the operator.

FINISHING MEDIA

By the term "finishing media" as used herein, or its equivalent terms "finishing material" or "finishing medium", it is intended to include loose, comminuted, granular, or particulate, and in any event solid finishing materials of the type presently employed in the trade and others of a similar nature. Although liquid finishing materials or "compound" may also be used in conjunction with solid finishing materials, these are considered to be ancillary, since most finishing processes employ some solid finishing medium. Moreover, the terms first set forth in this paragraph are used generally and herein to designate such solid materials which are used to impart all types of finishes, including those finishes acquired with abrading materials as well as polishing materials and the like, "polishing", "burnishing", and so on being terms considered in their usual sense as species of "finishing". Such suitable finishing media include, inter alia, porcelain, ceramic, aluminum, steel, zinc, stainless steel, and granite chips, and the like, all as well-known in the art, and in various sizes and configurations, also as well-known in the art, such configurations representatively being cones, bars, cylinders, squares, stars and the like.

OPERATION

In operation, finishing machines assembled in accord with FIGS. 3 and 4 and lined in accord with FIG. 5 exhibited greatly increased structural stability, with the result that the same mass of finishing media and parts to be finished could be employed in a finishing machine embodying a finishing chamber according to the present invention for an entirely satisfactory finishing operation with a universal motor having a horsepower substantially reduced in comparison to the motor required for a finishing operation employing the same mass of media and parts in a conventional finishing machine. Alternatively, the time cycle required for a particular desired finishing effect was shortened. Additionally, the noise level was considerably less, up to as much as three (3) decibels less in some cases, due to the fact that all of the energy employed was imparted to the finishing media and parts and was not wasted upon flexing of the various structural elements comprising the finishing chamber. Moreover, the "roll" of finishing media and parts was uniform and totally acceptable throughout, and no dead spots or other variations in the movement of the mass of finishing media and parts was discernible during a test period of many hours of finishing operations carried out in vibratory finishing machines embodying a chamber according to the present invention.

CIRCULAR, ANNULAR, CYLINDRICAL, CONICAL

When an essentially cylindrical tube is referred to herein, or an essentially circular tank head, or an essentially conical gusset or collar, it is intended to convey that the structure is essentially cylindrical, circular, or conical, but that it only need be such to the extent that the operativeness of the chamber produced therefrom is not seriously impaired. Obviously, for best results, completely circular tank heads, completely conical collars, and completely cylindrical tubes for center columns are most highly desirable, so that the terms "circular", "cylindrical", "conical", or "annular" can be most advantageously applied, but it is only necessary that the center column, the tube comprising the same, the collar or gusset, and the tank head be respectively generally cylindrical, conical, circular, or annular, and not essential that these elements be such in any precise sense of the term. It is only necessary that the finishing chamber and the central column and walls thereof be generally circular, cylindrical, or annular, that is, insufficiently cornered so as to prevent the free flow of finishing media and the parts to be finished therein in and around the interior of the finishing chamber. For example, the generally-annular or circular finishing chamber, as well as the generally cylindrical center column, and especially the inner and outer walls of the assembled bowl, may have a decagonal, octagonal, hexagonal, or pentagonal cross section, or any other somewhat cornered cross-section which does not detract from its generally-annular nature or interfere with the flow of parts and media about the interior of the finishing chamber when assembled. Although for purposes of ultimate convenience and operating efficiency a truly circular center column and tank head, annular inner and outer walls of the assembled and completed finishing chamber, and a conical collar, are preferred, other generally-circular finishing chambers and center columns, generally annular inner and outer walls, and generally conical collars or gussets may be employed with equal or only somewhat reduced efficiency, as will be readily apparent to one skilled in the art.

It is thereby seen from the foregoing that the objects of the present invention have been accomplished and that an extremely simple procedure for the production of a chamber, especially a finishing chamber, adapted to be the finishing chamber of a finishing machine or the like, has been provided thereby, as well as the chamber itself and a finishing machine comprising the said chamber, and whereby all of the previously-mentioned advantages have been attained.

Although the preferred embodiments of the invention have been illustrated in the accompanying drawings and described in the foregoing description, it is to be understood that the invention is not limited to the embodiments disclosed or to the exact details of operation or exact compounds, compositions, methods or procedures shown and described, since the invention is capable of numerous modifications, rearrangements, and substitutions of parts and elements and other equivalents, both metallurgical and mechanical, without departing from the spirit or scope of the invention, as will readily be apparent to one skilled in the art.

I claim:

1. A structure suitable for use as at least a part of the finishing chamber of a vibratory finishing machine, comprising an essentially cylindrical tube comprising the center column of the finishing chamber, an essentially circular tank head, having a bottom and an upwardly extending outer wall and a circumference selected so as to constitute the outer circumference of the chamber comprising the bottom portion of said chamber, with an essentially circular opening in the bottom thereof having a circumference corresponding to the circumference of said cylindrical tube, said cylindrical tube being inserted through the essentially circular opening in said tank head and in circumferential contact therewith, said cylindrical tube and said tank head being welded to secure them to each other at said point of contact.

2. A chamber suitable for use as the finishing chamber of a vibratory finishing machine, comprising an essentially cylindrical tube comprising the center column of the finishing chamber, an essentially circular tank head, having a bottom and an upwardly extending outer wall and a circumference selected so as to constitute the outer circumference of the chamber comprising the bottom portion of said chamber, with an essentially circular opening in the bottom thereof having a circumference corresponding to the circumference of said cylindrical tube, a cone-shaped gusset with an essentially circular opening in the top thereof and a skirt outwardly and downwardly extending from said opening, said opening having a circumference corresponding to the circumference of said cylindrical tube, said gusset having an outer circumference less than the circumference of said tank head, said cylindrical tube being inserted through the essentially circular opening in said tank head and in circumferential contact therewith, said cone-shaped gusset being inserted over said cylindrical tube with its outer circumference within said upwardly extending outer wall of said tank head and in circumferential contact with said tank head, and with its circular opening around said cylindrical tube and in circumferential contact therewith, said cylindrical tube, said tank head, and said gusset being welded to secure them to each other at said points of contact.

3. A chamber of claim 2, comprising an elastomeric lining on the inner surface thereof.

4. A finishing machine comprising a chamber of claim 2.

5. A finishing machine comprising a chamber of claim 2, which is a vibratory finishing machine and wherein said chamber is resiliently mounted.

* * * * *